US006860337B1

(12) United States Patent
Orr et al.

(10) Patent No.: US 6,860,337 B1
(45) Date of Patent: Mar. 1, 2005

(54) INTEGRATED MAST AND TOP DRIVE FOR DRILLING RIG

(75) Inventors: Alan Orr, Tulsa, OK (US); George Dotson, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 10/350,829

(22) Filed: Jan. 24, 2003

(51) Int. Cl.[7] ..... E21B 7/02

(52) U.S. Cl. ..... 173/28; 173/27; 173/1; 173/25

(58) Field of Search ..... 173/1, 28, 27, 173/25

(56) References Cited

U.S. PATENT DOCUMENTS

| | | | | |
|---|---|---|---|---|
| 3,922,825 A | * | 12/1975 | Eddy et al. | 52/116 |
| 3,983,946 A | * | 10/1976 | Pereau | 173/1 |
| 3,994,350 A | * | 11/1976 | Smith et al. | 175/85 |
| 4,078,617 A | * | 3/1978 | Cherrington | 173/1 |
| 4,138,805 A | * | 2/1979 | Patterson | 52/118 |
| 4,368,602 A | * | 1/1983 | Manten | 52/115 |
| 4,371,041 A | | 2/1983 | Becker et al. | 173/28 |
| 4,753,300 A | | 6/1988 | Shaw et al. | 173/164 |
| 4,821,814 A | | 4/1989 | Willis et al. | 173/164 |
| 4,899,832 A | | 2/1990 | Bierscheid, Jr. | 173/23 |
| 5,107,940 A | | 4/1992 | Berry | 175/85 |
| 5,381,867 A | | 1/1995 | Berry | 175/85 |
| 5,755,296 A | | 5/1998 | Richardson et al. | 175/162 |
| 5,794,723 A | | 8/1998 | Caneer, Jr. et al. | 175/85 |
| 6,024,181 A | | 2/2000 | Richardson et al. | 175/162 |
| 6,257,349 B1 | | 7/2001 | Bardwell | 173/28 |
| 6,533,045 B1 | * | 3/2003 | Cooper | 173/28 |
| 6,634,436 B1 | * | 10/2003 | Desai | 173/1 |

FOREIGN PATENT DOCUMENTS

| | | | |
|---|---|---|---|
| CA | 1169627 | 6/1984 | E21B/15/00 |
| EP | 1176283 A2 | 1/2002 | E21B/7/02 |
| WO | WO 00/11306 | 3/2000 | E21B/15/00 |

OTHER PUBLICATIONS

Jackson et al, portable top dirve cuts horizontal drilling costs, Nov. 1993, World Oil, v214, n11, p81(5).*

Mehra S. & Bryce T, "Innovative Technology For a Cost Effective Land Rig", SPE 35046, Mar. 12, 1996, XP–002286559, p. 105–116.

"Rig Integration", Estec Oilfield, online, XP002286704, Retrieved from the Internet: http://www.oilfield.esec.ca/products/integration.htm.

Article regarding Applicant— "Contractors"Building State–of–the–art Land Rigs, Drilling Contractor, Sep./Oct. 2002, XP002286703, p. 22.

* cited by examiner

*Primary Examiner*—Scott A. Smith
*Assistant Examiner*—Brian Nash
(74) *Attorney, Agent, or Firm*—Head, Johnson & Kachigian

(57) ABSTRACT

A process to lower or raise a drilling rig for transportation wherein the drilling rig includes a mast and a top drive. The process to lower includes the steps of moving the top drive within the mast with a vertical guide and torque reaction mechanism to a locked position and locking the top drive to the mast with a locking mechanism. The mast and the top drive are lowered together from a vertical position to a horizontal position. The combined mast and top drive may then be transported in the horizontal position without disconnecting electrical, mud line or other services.

10 Claims, 8 Drawing Sheets

INTEGRATED MAST AND TOP DRIVE FOR DRILLING RIG

BACKGROUND OF THE INVENTION

1. Field of the Invention

The present invention provides an apparatus and a process wherein a mast and a top drive drilling system are integrated together in a drilling rig so that the top drive remains installed within the mast along with ancillary services and connections at all times. In particular, the present invention provides an integrated mast and top drive for a drilling rig wherein the top drive remains installed within the mast during the process of mast lowering, during the process of mast transportation from location to location, and during the process of mast raising.

2. Prior Art

It is often desirable to move a large drilling rig, including all of its equipment, from one well bore to another. In the past, in order to move a drilling rig, it has been necessary to disassemble or "rig down" the drilling structure, which requires disconnecting all ancillary services and laying down of the mast from a vertical to a horizontal position, moving the drilling structure to an alternate well bore, and then reassembling the entire drill structure and reconnecting all ancillary services.

The drilling site and drilling rig may be configured in various known ways and may include various equipment. The drilling rig will often include an upstanding mast having an open face connected to the floor of the drilling rig. The mast may extend vertically 40 to 50 meters or more and supports a crown assembly at the top. The mast and floor are above and connected to an elongated drilling rig substructure. The drilling rig configuration is generally well known in the art.

Rather than using traditional kelly and rotary table mechanisms to rotate a drilling string and a bit in a drilling rig, top drive drilling systems have been developed over the years. The top drive is an electric motor or, in some cases, a hydraulic motor, which is suspended within a derrick or a mast of a drilling rig and is capable of moving vertically within the derrick or mast. The top drive rotates the drilling string and the bit and reduces the amount of manual labor and associated hazards traditionally accompanying these operations.

While top drive systems have been developed over the years, they are traditionally installed on the drilling rig after the mast has been raised from the horizontal to the vertical position. Additionally, they are traditionally removed from the mast of the drilling rig prior to lowering the mast from the vertical to the horizontal position. Moreover, the top drive drilling system is often moved separately from the mast. Because the top drive is traditionally removed from the rig for mast lowering and then reattached after mast raising, the various connections, such as electrical, hydraulic or other connections, must be attached and then reattached during the mast lowering, mast transportation and mast raising processes.

It would be advantageous to provide an integrated mast and top drilling system so that the top drive remains connected to the mast at all times.

It would also be advantageous to provide an integrated mast and top drive in a drilling rig wherein electrical services and other connections extending from the top drive are prevented from swinging or hanging up in the rig and remain connected to the mast at all times.

It would also be advantageous to provide an integrated mast and top drive in a drilling rig wherein ancillary services, such as mud lines, extending from the top drive remain connected to the mast at all times.

It would also be advantageous to provide an integrated mast and top drive wherein the top drive could be locked to the mast to facilitate raising, lowering and transporting the mast with the tope drive in place and to perform maintenance activities on the top drive when the mast is in the raised condition.

SUMMARY OF THE INVENTION

The present invention is directed to an integrated mast and top drive for a drilling rig. The drilling rig may include a mast comprised of two sections, an upper mast section and a lower mast section which are assembled together for use. In one preferred embodiment, the mast includes a crown assembly arrangement at the top of the upper mast section over the well bore. A top drive system is suspended by wire line from the crown assembly and moves vertically within the mast toward or away from the well bore.

The mast may include a left side, a right side, and a back side with an open front face. The mast is capable of pivoting about pivot points at the base of the lower section of the mast. The mast will be moved in a radial direction from a vertical position to a horizontal position for transportation. Conversely, the mast will be moved in a radial direction from a horizontal transportation system to a vertical system for use.

The top drive moves vertically within the mast along a vertical guidance and torque reaction mechanism. The vertical guidance and torque reaction mechanism includes a plurality of pads extending from the top drive. The pads engage a pair of structural guide rails comprised of a pair of rectangular tubes which extend the length of the mast. Each guide rail is substantially parallel with its respective side leg. The guide rails are composed of an upper and lower section corresponding with the upper and lower mast section. The engagement of the pads with the structural guide rails prevents twisting, radial, or torque reaction movement of the top drive during its operation.

During the process to lower the drilling rig from the vertical position to the horizontal position for transportation, during the transportation and during the process to raise the drilling rig from a horizontal position to the vertical position, the top drive will remain engaged with and locked to the mast at all times. Accordingly, the necessity of removing the top drive and disconnecting its connections is eliminated.

A flexible drag chain having a plurality of individual links and an open passageway extends at all times between the top drive and the lower mast section. The drag chain is flexible and operates within an open channel or tray on the mast. Electrical or other cables run within the drag chain in order to supply electric service to the top drive. It is, thus, not necessary to connect or disconnect electrical service to the top drive during the rig up or rig down.

Drilling mud will also be supplied to the top drive from a connection on the mast through a flexible hose or line. Since the top drive will not be disconnected, mud line service will also remain connected at all times between the top drive and the mast.

A locking mechanism is provided to lock the top drive to the mast. A pin or a pair of pins will be received through a bracket on a lower mast and then received within an aligned bracket on the top drive. When the pins are inserted and in place, the top drive will be locked to the mast and is rigidly attached for lowering of the mast, transportation of the mast and raising of the mast. The top drive may also be locked to the mast in order to perform maintenance activities on the top drive.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 2:
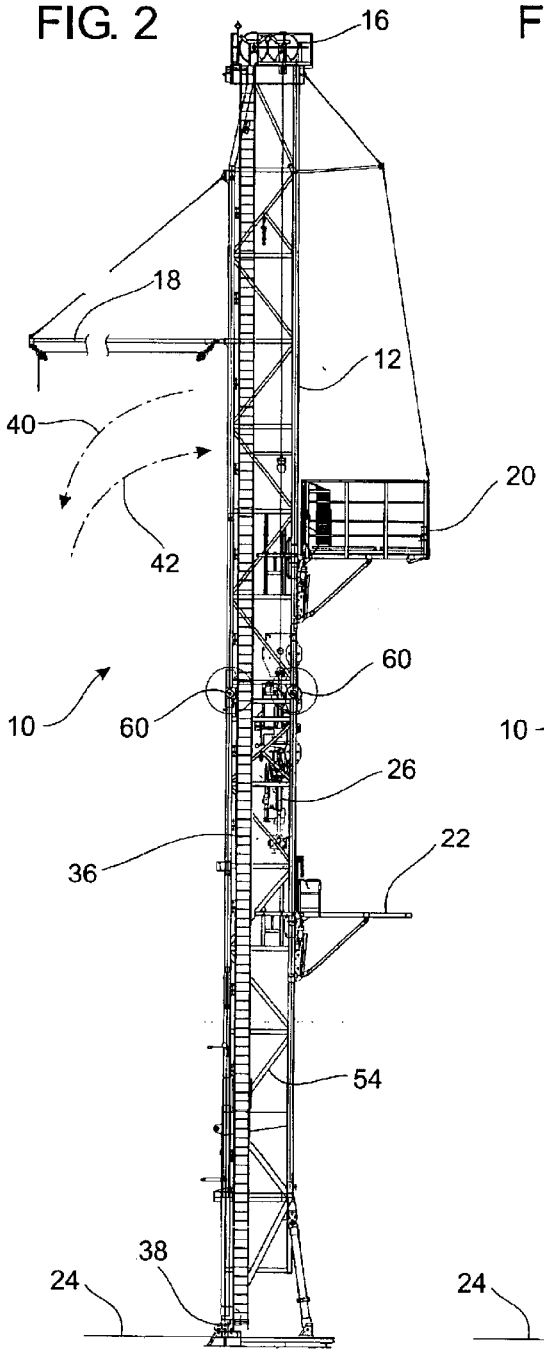
FIG. 1 illustrates a front view and FIG. 2 illustrates a left side view of a drilling rig incorporating the teachings of an integrated mast and top drive of the present invention.
Figure 1:
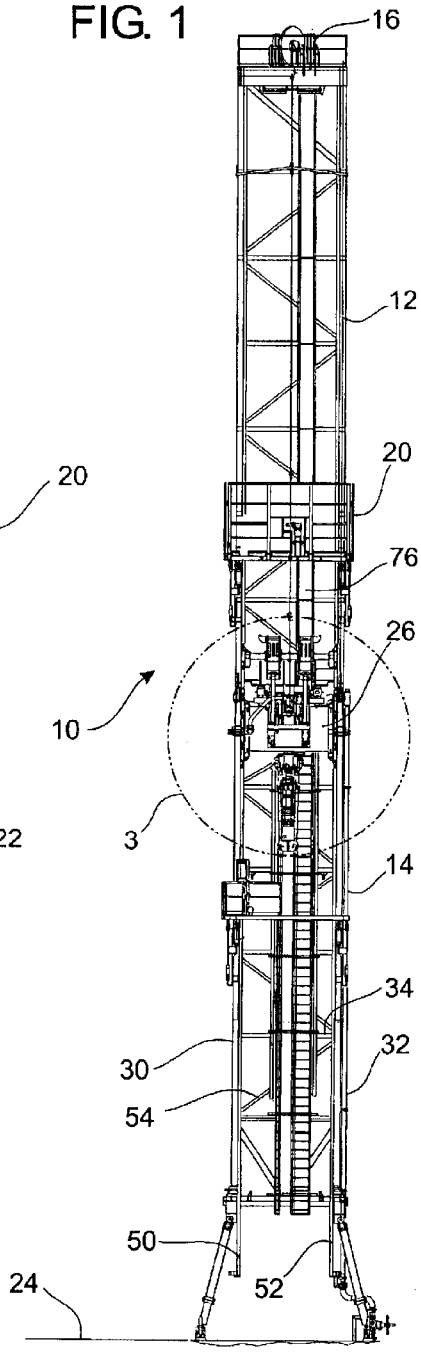

Referring to the drawings in detail, FIG. 1 shows a front view and FIG. 2 illustrates a left side view of a drilling rig incorporating the present invention. The drilling rig includes a mast 10 comprised of two sections, an upper mast section 12 and a lower mast section 14 which are assembled together for use as seen in FIGS. 1 and 2.

The drilling rig may take any number of known configurations. In one preferred embodiment, the mast 10 includes a crown assembly arrangement 16 at the top of the upper mast section. The crown assembly may include various sheaves and pulleys over the well bore. The upper mast section 12 may also include a jib boom 18 and a racking board 20 which supports stands of pipe stored for use. The lower mast section 14 may include a tubing board 22 with the base of the lower mast section 14 resting on a drill floor 24.

A top drive system 26 is suspended by wire line from the crown assembly 16 and moves vertically within the mast 10 toward or away from the well bore.

In the embodiment shown, the mast 10 includes a left side 30, a right side 32, and a back 34 with an open front face as best seen in FIG. 1. The mast may also include various cross-bracing 54. The left side may include a ladder 36 as seen in FIG. 2.

The drilling rig is shown in a vertical position in FIGS. 1 and 2 for use in the drilling operations. The mast 10 is capable of pivoting about pivot points 38 at the base of the lower section 14 of mast 10. The mast 10 will be moved in a radial direction from the position shown in FIGS. 1 and 2 to a horizontal position for transportation as shown by arrow 40 in FIG. 2. Conversely, the mast 10 will be moved in a radial direction from a horizontal transportation system to the vertical position shown in FIGS. 1 and 2 about pivot points 38 as shown by arrow 42 in FIG. 2.

Figure 3:
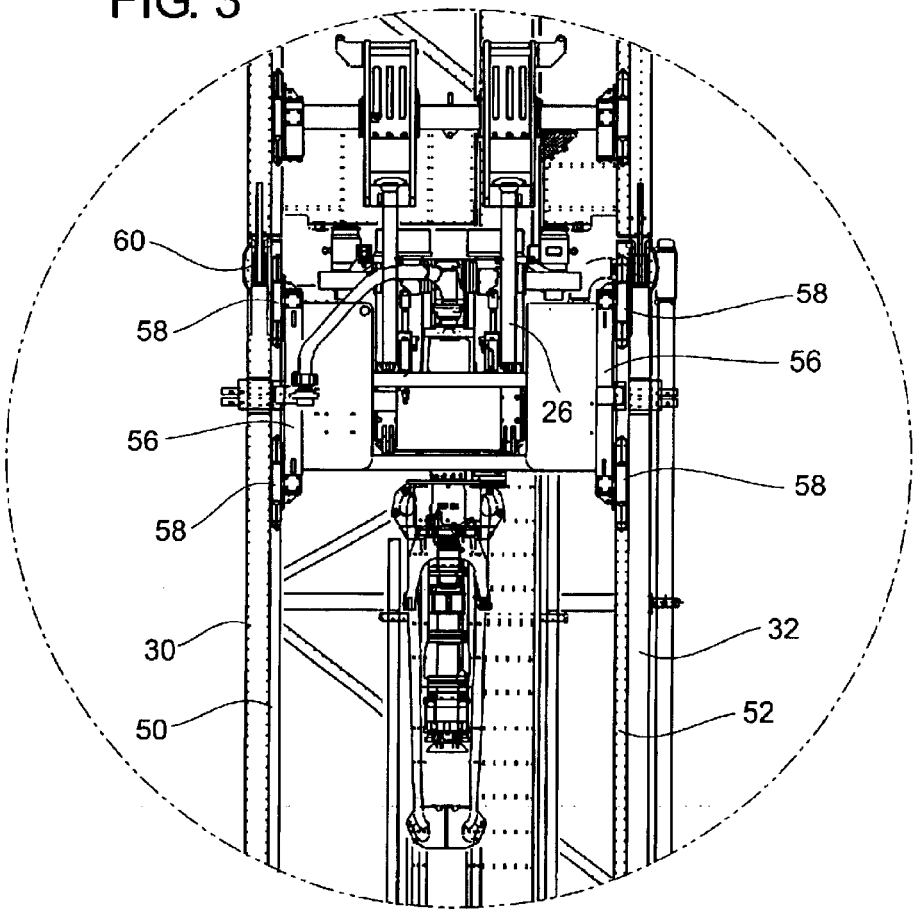
FIG. 3 illustrates an enlarged view of a portion of the lower mast section of the drilling rig shown in dashed lines in FIG. 1.

FIG. 3 is an enlarged view of a portion of the lower mast section 14 along with the top drive 26 as shown in the dashed lines in FIG. 1. The top drive 26 will rotate the drilling string and the bit. The top drive 26 moves vertically within the mast along a vertical guidance and torque reaction mechanism 56. The vertical guidance and torque reaction mechanism 56 includes a plurality of pads 58 extending from the top drive 26. The pads 58 engage a pair of structural guide rails 50 and 52 comprised of rectangular tubes which extend the length of the mast 10. In the present embodiment, each guide rail 50 and 52 is substantially parallel with its respective side 30 or 32 and is composed of an upper and lower section. The structural guide rails prevent twisting, radial or torque reaction movement of the top drive during its operation. The structural guide rails 50 and 52 may also be seen in FIG. 1.

Figure 4:
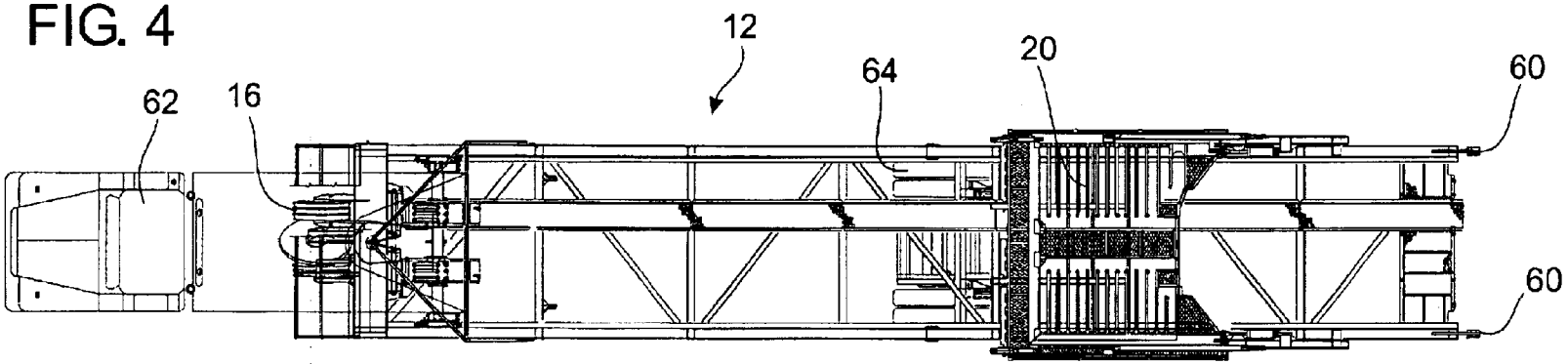
FIG. 4 illustrates a top view and FIG. 5 illustrates a left side view of an upper mast section loaded for transportation on a vehicle.
Figure 5:
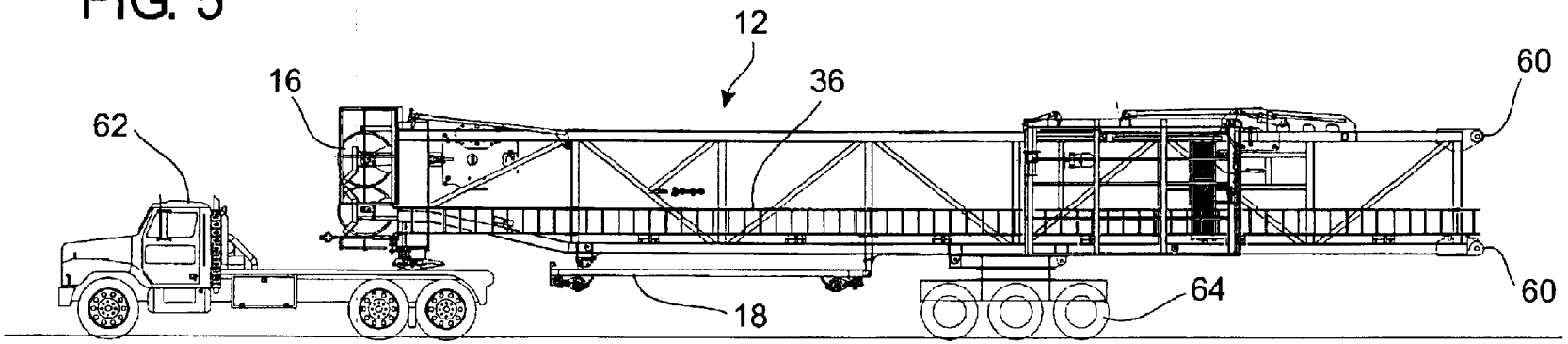

In the process of the present invention to lower the drilling rig for transportation, the mast 10 will be moved from the vertical position shown in FIGS. 1 and 2 to the horizontal position in a radial arc in the direction of the arrow 40. The upper mast section 12 may be lowered for transportation onto a vehicle 62 and a dolly 64 as seen in FIGS. 4 and 5. Thereafter, while in the horizontal position, the upper mast section 12 may be separated from the lower mast section 14 at connection points 60. The lower mast section will then be supported by a jack or similar arrangement in the horizontal position.

Figure 6:
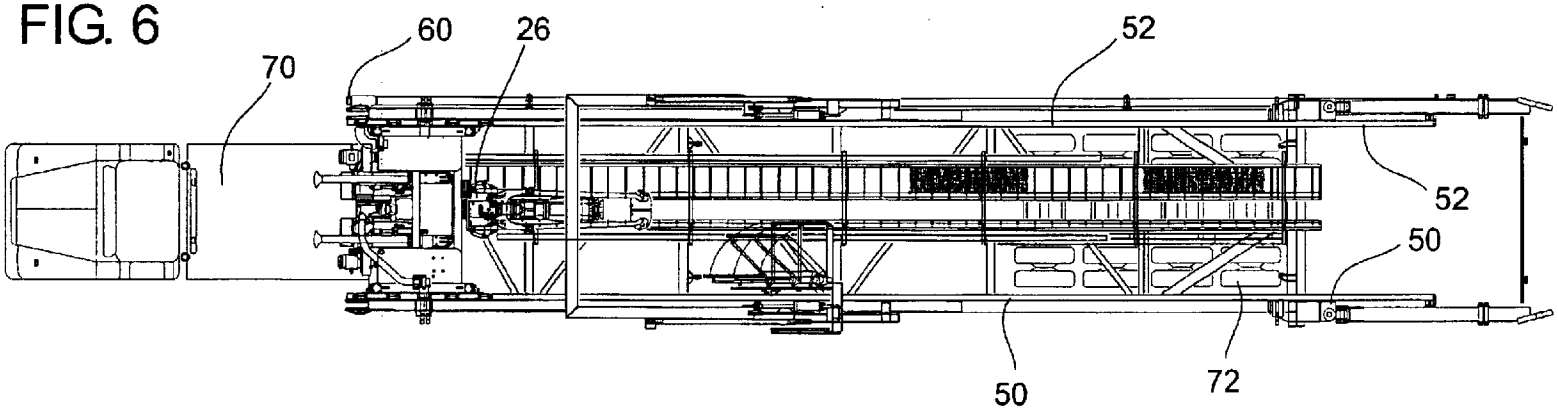
FIG. 6 illustrates a top view and FIG. 7 illustrates a left side view of a lower mast section loaded for transportation on a vehicle.
Figure 7:
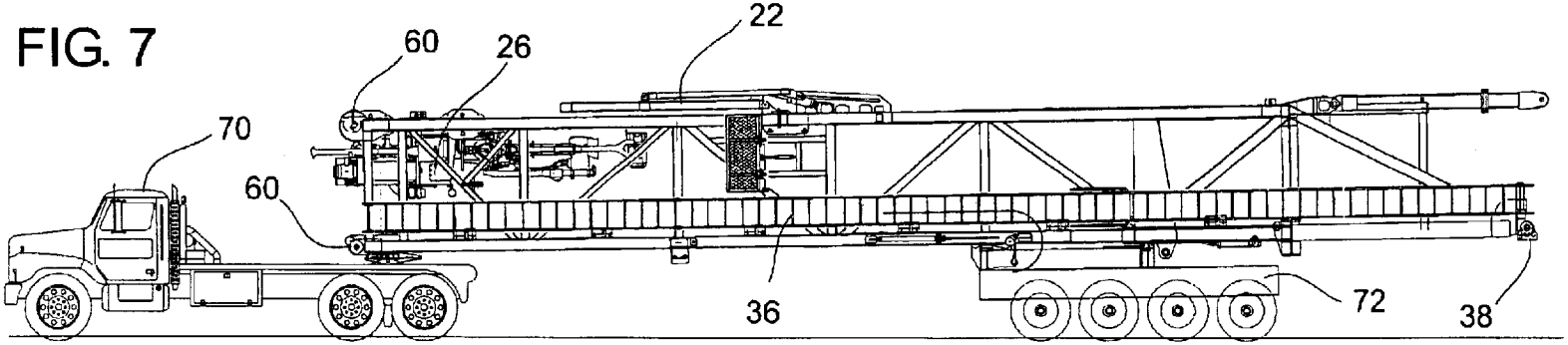

Thereafter, as seen in FIGS. 6 and 7, the lower mast section 14 may be lowered onto a vehicle 70 and a dolly 72 for transportation to another site. The top drive 26 remains engaged with and locked to the mast 10 during the process of lowering, while the lower mast section 14 is on the vehicle 70 and during transportation and raising of the mast 10 at a new location. Accordingly, the necessity of removing the top drive from the mast is eliminated.

The lower mast section and top drive will be transported together on a vehicle while the upper mast section will be transported on a vehicle.

Figure 8:
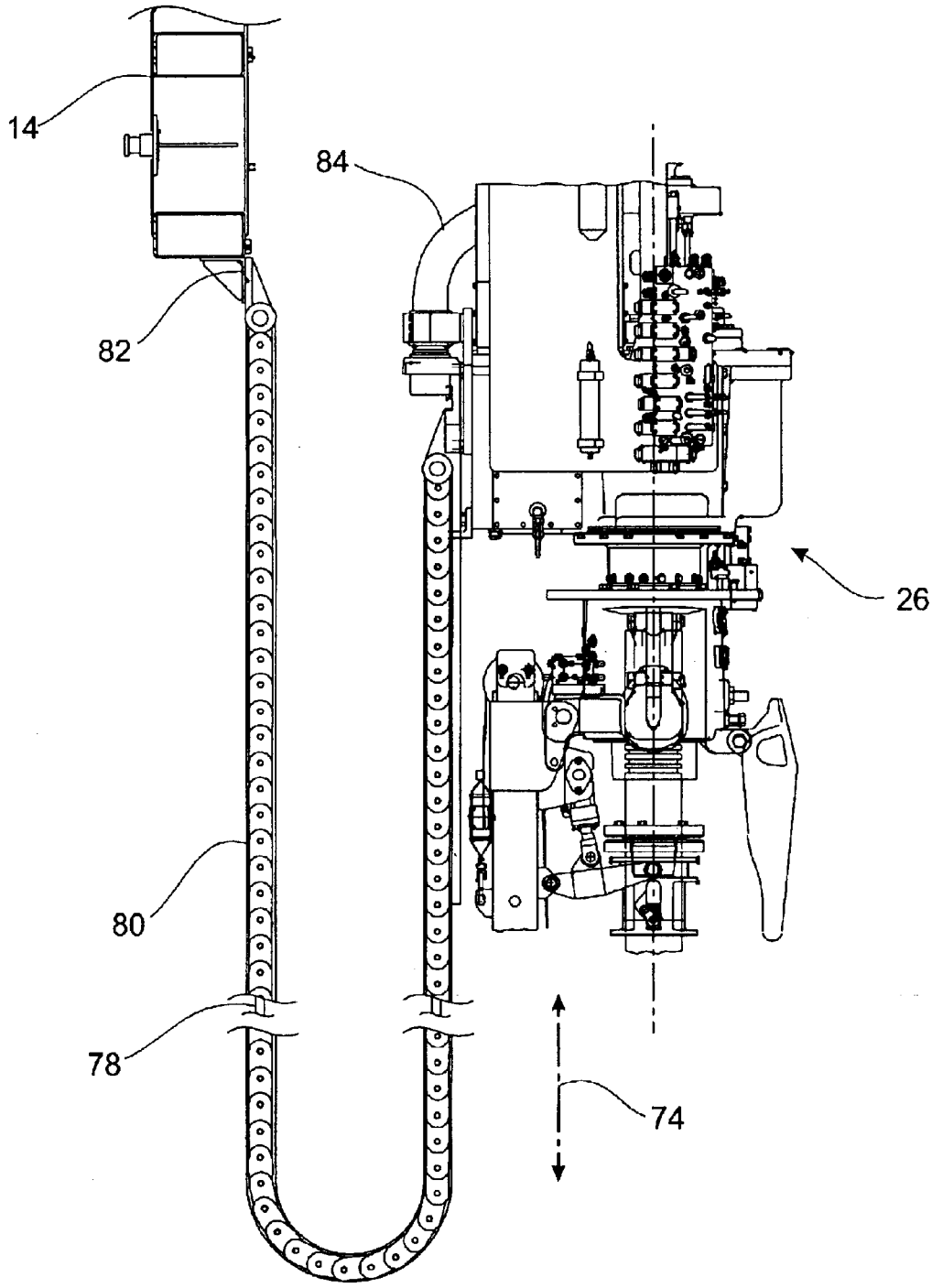
FIG. 8 illustrates a partial view of a top drive and connecting electrical service for the integrated mast and top drive for a drilling rig constructed in accordance with the present invention.

FIG. 8 shows a portion of the top drive 26 apart from the mast 10. A flexible drag chain 80 having a plurality of individual links and an open passageway extends at all times between the top drive. 26 and a bracket 82 connected to the lower mast section 14 of the mast (a portion shown in FIG. 8). The drag chain 80 is flexible and operates within an open channel guide or tray 76 on the mast. Accordingly, vertical movement shown by arrow 74 of the top drive 26 is accommodated. Electrical and other cables 78 run within the drag chain to supply electric service to the top drive 26. It is, thus, not necessary to connect or disconnect electrical service to the top drive during rig up or rig down.

Drilling mud will also be supplied to the drive top 26 from a connection line 84 on the mast 10 through a hose or line (not seen in FIG. 8).

Figure 8A:
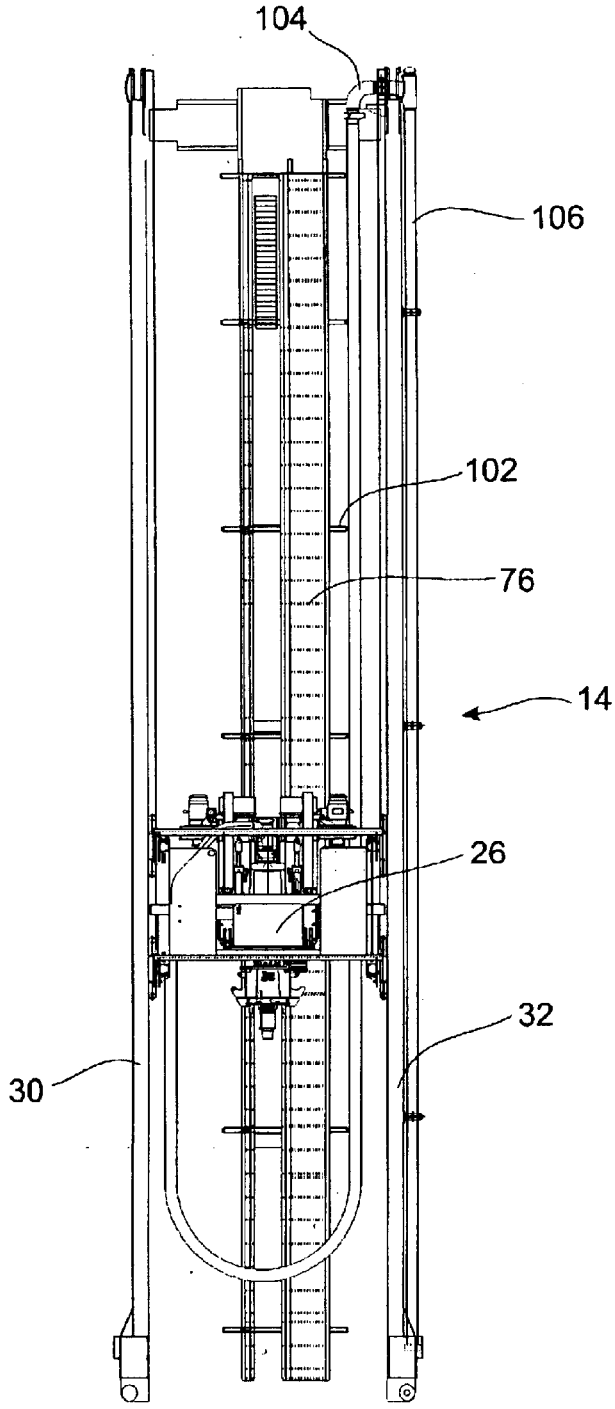
FIG. 8A illustrates a partial view of a rear of the lower mast section of the present invention with the top drive and connecting mud line service.

FIG. 8A illustrates a partial view of a front of the lower mast section 14 apart from the rest of the mast with the top drive 26 visible. A flexible hose or line, such as hose 102, will extend from the connection line 84 (seen in FIG. 8 but not visible in FIG. 8A) from the top drive 26 and will be connected to a fitting 104 mounted on the lower mast section 14. The fitting 104 is, in turn, in fluid communication with pipeline 106 which is connected to the mud service facilities of the drilling rig, such as mud tanks, vibrating shakers and other equipment to supply and recirculate drilling mud (not shown). Since the top drive will not be disconnected during lowering, raising or transportation, mud line service will be connected at all times between the top drive 26 and the mast by the hose 102 which will connect to line 84.

Figure 9:
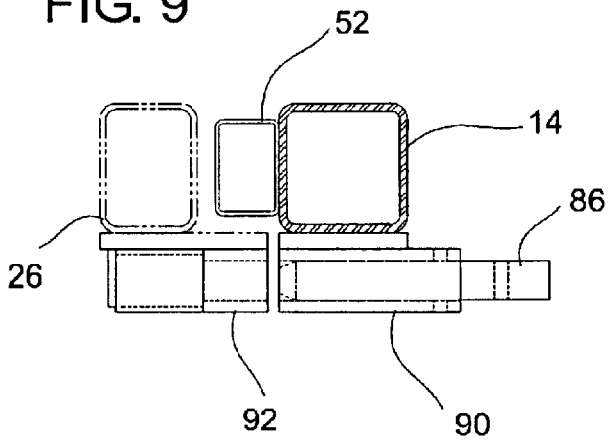
FIGS. 9, 10 and 11 show alternate views of a locking mechanism to lock a top drive to a mast in accordance with the present invention.
Figure 10:
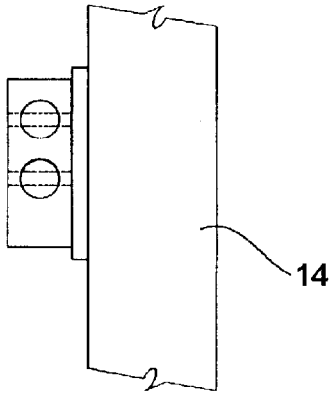
Figure 11:
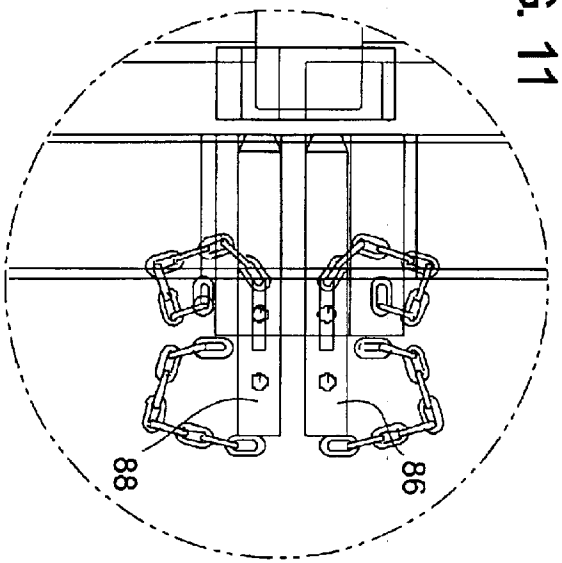

FIGS. 9, 10 and 11 illustrate a locking mechanism to lock the top drive 26 to the mast. FIG. 9 is a cross-sectional view of the lower mast 14, guide rail 52 and top drive 26. A pin or, in the preferred embodiment, a pair of pins 86 and 88 will be received through a bracket 90 on the lower mast 14 and then received within an aligned bracket 92 on the top drive. When the pins 86 and 88 are in place, the top drive 26 will be locked to the mast 10 and is rigidly attached for lowering, transportation and raising of the mast.

Figure 12:
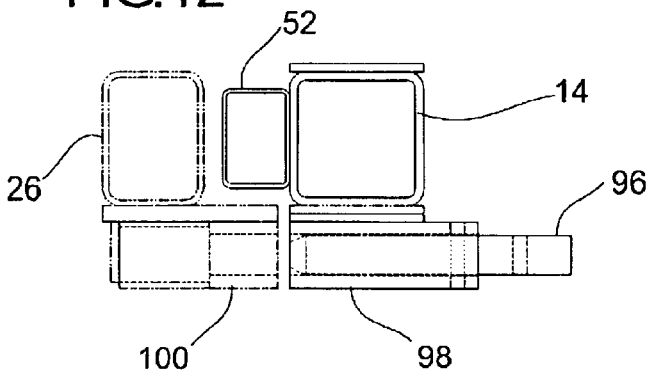
FIGS. 12, 13 and 14 show an alternate locking mechanism to lock a top drive to a mast in accordance with the present invention.
Figure 13:
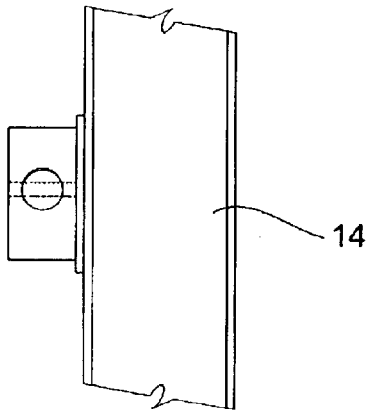
Figure 14:
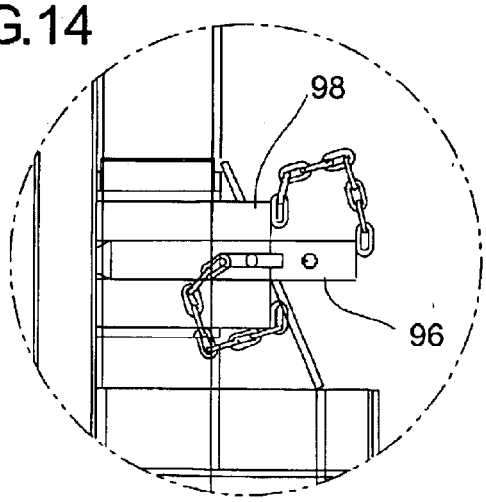

FIGS. 12, 13 and 14 show an alternate locking mechanism wherein the top drive 26 may be locked to the lower mast lower section 14 near to the drilling floor (not seen). FIG. 12 is a cross-sectional view of the lower mast 14. In the embodiment shown in FIGS. 12, 13 and 14, a single pin 96 is received through a bracket 98 on the lower mast and received within an aligned bracket 100 on the top drive 26.

Whereas, the present invention has been described in relation to the drawings attached hereto, it should be understood that other and further modifications, apart from those shown or suggested herein, may be made within the spirit and scope of this invention.

What is claimed is:

1. A process to lower a drilling rig for transportation, said drilling rig having a mast, a top drive, and a hoisting system wherein said hoisting system includes a wireline and a crown assembly to raise and lower said top drive, which process includes the steps of:

moving said top drive within said mast with a vertical guidance and torque reaction mechanism to a lock position with respect to said mast;

locking said top drive in a rigid fixed position to said mast with a locking mechanism by mechanically fastening said top drive to said mast wherein the fastening elements of the locking mechanism are independent of the hoisting system;

lowering said mast and said top drive together from a vertical position to a horizontal position; and transporting said combined mast and top drive in said horizontal position.

2. A process to lower a drilling rig as set forth in claim 1 wherein said step of moving said top drive within said mast includes the step of moving said top drive with said vertical guidance and torque reaction mechanism along a pair of structural guide rails.

3. A process to lower a drilling rig as set forth in claim 1 including the additional step of separating an upper mast section from a lower mast section of said mast after lowering of said mast and said top drive and prior to transporting.

4. A process to raise a drilling rig from a transportation position to a use position, said drilling rig having a mast, a top drive, and a hoisting system wherein said hoisting system includes a wireline and crown assembly to raise and lower said top drive, which process includes the steps of:

transporting said mast and top drive together in a horizontal position;

raising said combined mast and top drive from said horizontal position to a vertical position;

unfastening said top drive from a rigid fixed position to said mast with by unlocking a locking mechanism which mechanically fastens said top drive to said mast wherein the fastening elements of the locking mechanism are independent of the hoisting system; and moving said top drive with a vertical guidance and torque reaction mechanism from a locked position.

5. A process to raise a drilling rig as set forth in claim 4 wherein the step of moving said top drive includes the step of moving said top drive with said vertical guidance and torque reaction mechanism along a pair of structural guide rails attached to said mast.

6. A process to raise a drilling rig as set forth in claim 4 wherein an upper mast section of said mast is separate from a lower mast section of said mast during said step of transporting and are joined together prior to said step of raising.

7. A process to lower a drilling rig for transportation, said drilling rig having a mast and a top drive, which process includes the steps of:

moving said top drive within said mast with a vertical guidance and torque reaction mechanism to a lock position;

locking said top drive to said mast with a locking mechanism;

lowering said mast and said top drive together from a vertical position to a horizontal position;

separating an upper mast section from a lower mast section;

transporting said combined mast and top drive in said horizontal position; and retaining electrical service to said top drive during the entire process through a drag chain which operates within a guide.

8. A process to lower a drilling rig for transportation, said drilling rig having a mast and a top drive, which process includes the steps of:

moving said top drive within said mast with a vertical guidance and torque reaction mechanism to a lock position;

locking said top drive to said mast with a locking mechanism;

lowering said mast and said top drive together from a vertical position to a horizontal position;

separating an upper mast section from a lower mast section;

transporting said combined mast and top drive in said horizontal position; and retaining mud line service to said top drive during all steps of said process.

9. A process to raise a drilling rig from a transportation position to a use position, said drilling rig having a mast and a top drive, which process includes the steps of:

transporting said mast and top drive together in a horizontal position;

joining an upper mast section of said mast to a lower mast section of said mast;

raising said combined mast and top drive from said horizontal position to a vertical position;

unlocking said top drive from said mast by unlocking a locking mechanism;

moving said top drive with a vertical guidance and torque reaction mechanism from a locked position; and retaining electrical service to said top drive during the entire process through a drag chain which operates within a channel.

10. A process to raise a drilling rig from a transportation position to a use position, said drilling rig having a mast and a top drive, which process includes the steps of:

transporting said mast and top drive together in a horizontal position;

joining an upper mast section of said mast to a lower mast section of said mast;

raising said combined mast and top drive from said horizontal position to a vertical position;

unlocking said top drive from said mast by unlocking a locking mechanism;

moving said top drive with a vertical guidance and torque reaction mechanism from a locked position; and retaining mud line service to said top drive during all steps of said process.

* * * * *